US006758121B2

(12) United States Patent
Peters et al.

(10) Patent No.: US 6,758,121 B2
(45) Date of Patent: Jul. 6, 2004

(54) DEVICE FOR CUTTING A FIBER CABLE

(75) Inventors: Herbert Peters, Neumunster (DE); Matthias Strebe, Neumunster (DE)

(73) Assignee: Neumag GmbH & Co. KG, Neumunster (DE)

( * ) Notice: Subject to any disclaimer, the term of this patent is extended or adjusted under 35 U.S.C. 154(b) by 107 days.

(21) Appl. No.: 10/242,502

(22) Filed: Sep. 12, 2002

(65) Prior Publication Data

US 2003/0056376 A1 Mar. 27, 2003

(30) Foreign Application Priority Data

Sep. 25, 2001 (DE) ..... 101 47 233

(51) Int. Cl.[7] ..... D01G 1/04

(52) U.S. Cl. ..... 83/343; 83/698.51; 83/913; 83/955

(58) Field of Search ..... 83/913, 955, 592, 83/343, 731, 698.51

(56) References Cited

U.S. PATENT DOCUMENTS 3,062,082 A * 11/1962 Keith ..... 83/410.7
3,507,180 A * 4/1970 Greenberg ..... 83/592
4,083,276 A * 4/1978 Hutzezon ..... 83/37
4,169,397 A * 10/1979 Vehling et al. ..... 83/100
4,528,880 A 7/1985 Bauch
4,577,537 A 3/1986 Bauch
5,170,687 A * 12/1992 Ratjen et al. ..... 83/343

FOREIGN PATENT DOCUMENTS

DE 27 45 610 * 4/1979
EP 0 058 743 A1 9/1981
EP 0 059 234 A1 9/1981
GB 587850 * 5/1947

* cited by examiner

*Primary Examiner*—Kenneth E. Peterson
(74) *Attorney, Agent, or Firm*—Smith Moore LLP

(57) ABSTRACT

A device for cutting a fiber cable, in which a rotationally driven cutter supporting member and a rotatable pressing ring positioned at an incline relative to the cutter supporting member work together to cut the fiber cable. An annular channel formed on the outer circumference of the cutter supporting member is penetrated by a plurality of radially oriented cutting blades. The cutting blades are held in a cutter receiving member of a holding device, wherein a supporting ring radially supports the cutting blades. The width of the cutting blades is larger than the width of the annular channel. In order to consecutively use several areas of the cutting blades, the supporting ring is replaceable and is formed by an outer ring encircling the cutting blades or by an inner ring encircling the cutting blades. The cutting blades are held in the cutter receiving member and are radially moveable.

6 Claims, 3 Drawing Sheets

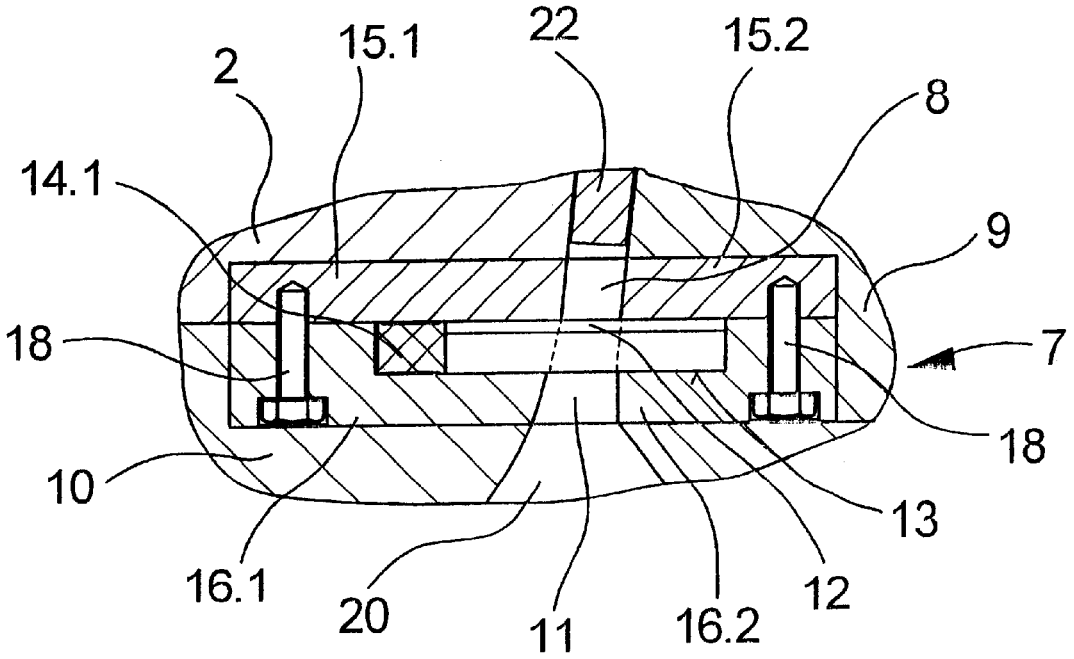
Fig.2.1
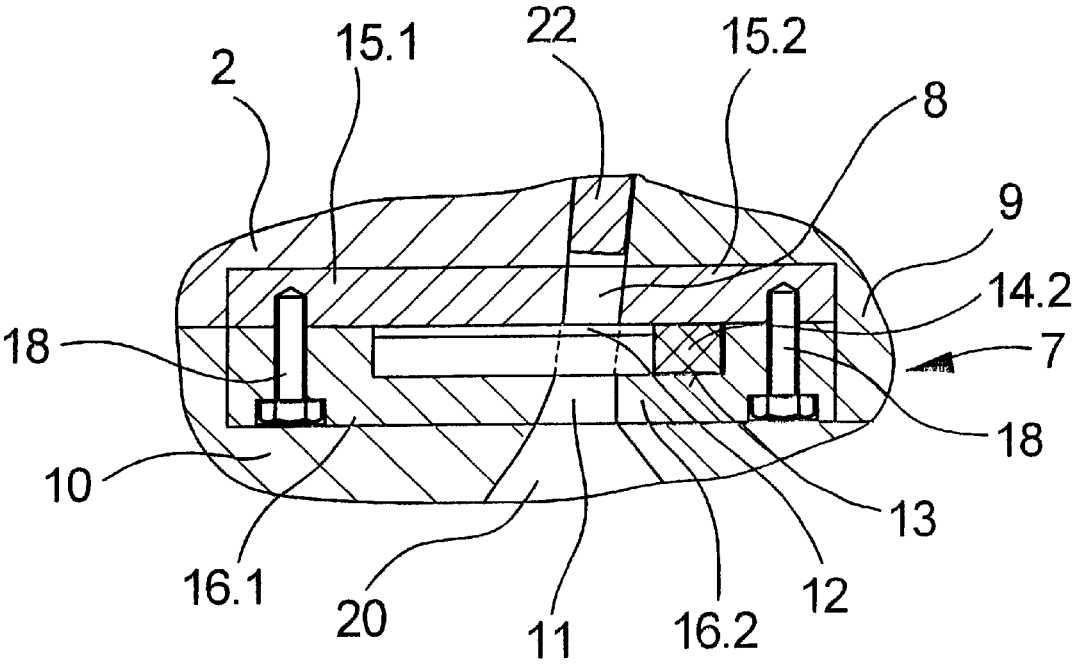
Fig.2.2

DEVICE FOR CUTTING A FIBER CABLE

BACKGROUND OF THE INVENTION

The invention relates to a device for cutting a fiber cable.

A device of this type is disclosed in European publication EP 0 058 743 A1.

The device of the prior art, which has been successfully used in cutting fiber cables, includes a rotationally symmetrical cutter supporting member that sits atop a driven shaft. Mounted on the cutter supporting member are a plurality of radially oriented cutting blades that penetrate an annular channel running around the outer edge of the cutter supporting member. Above the annular channel is a pressing ring that is mounted at such an angle that the pressing ring extends into the annular channel. A fiber cable that is threaded into the annular channel is pressed by the pressing ring against the radially positioned cutting blades in such a way that the fiber cable is cut and the cut fibers are released through the space between the cutting surfaces. Due to the great cutting force acting on the cutting blades, as well as the additional centrifugal forces, the cutting blades are affixed in a cutting receptacle of a holding device, which is mounted on the cutter supporting member. The cutting blades are locked in on both ends. For this reason, those areas on the ends of the cutters that are located outside of the annular channel, which are necessary for locking in the cutters, are unusable. If the cutting blades become dull, all of the cutters must be replaced.

Accordingly, there is a need in the art for a device for cutting fiber cables in such a way that allows longer use of the cutting surfaces, and thereby significantly extends the life of the cutting surfaces that must be replaced.

SUMMARY OF THE PRESENT INVENTION

The present invention solves this need in the art in that the radial support of the cutting blades in the support provided in the cutter receiving member can be replaced and is optionally formed by an outer ring surrounding the cutting blades or an inner ring enclosing the cutting blades and that the cutting blades are held in the cutter receiving member in such a way that they can be moved radially.

The invention is characterized in that several areas of the cutting blades can be used in cutting without requiring the costly replacement of the cutting blades. For instance, in order to use a first cutting area of the cutting blade, an outer ring is inserted into the cutter receiving member, which encloses the cutters and holds them in a radial inner position relative to the cutter supporting member. As soon as the area of the cutting blades used to cut the fiber cable is dulled, the outer ring in the cutter receiving member is replaced by an inner ring. For this, the cutting blades are simply moved radially toward the outside. The cutting blades are then held in a position that is radially outward relative to the cutter supporting member. The advantage of this is that the utilization life of the cutting blades is doubled.

In order to ensure that the entire area on the cutting blades that is used for cutting has a uniform sharpness, in accordance with one advantageous advancement of the invention the supporting ring is provided with a ring width that is larger than the cutting width acting on the cutting blade. Thus, there is no possibility that the areas of utilization on the cutting blade will overlap.

In a preferred embodiment of the present invention, the supporting device is mounted on the cutter supporting member in such a way that the cutter receiving member is aligned asymmetrically to the annular channel. The annular channel and therefore the effective cutting width of the cutting blade lies outside of the middle of the cutter receiving member. This allows the use of an additional area of utilization on the cutting blade. To this end, the cutting blades that have already been used in two areas are removed from the cutter receiving member and after being turned 180° are reinserted. The area of the cutter blade prior to now was unusable due to the asymmetrical mounting, can now be used for cutting the fiber cable without changing the position of the supporting ring.

In a further embodiment of the present invention, when the cutting blades are moved or replaced, there is no immediate risk of injury because the cutting surfaces of the cutting blades are held in a cutter holder. To this end the cutter holder has several slots in which the cutter blades are inserted with their cutting surfaces.

BRIEF DESCRIPTION OF THE FIGURES

The device according to the present invention is explained in more detail below and in the attached figures, in which:

FIG. 2.1 is a detailed schematic view of the device of FIG. 1 in a first position in accordance with the present invention;

FIG. 2.2 is a detailed schematic view of the device of FIG. 1 in a second position in accordance with the present invention.

DETAILED DESCRIPTION OF THE PREFERRED EMBODIMENTS

Figure 1:
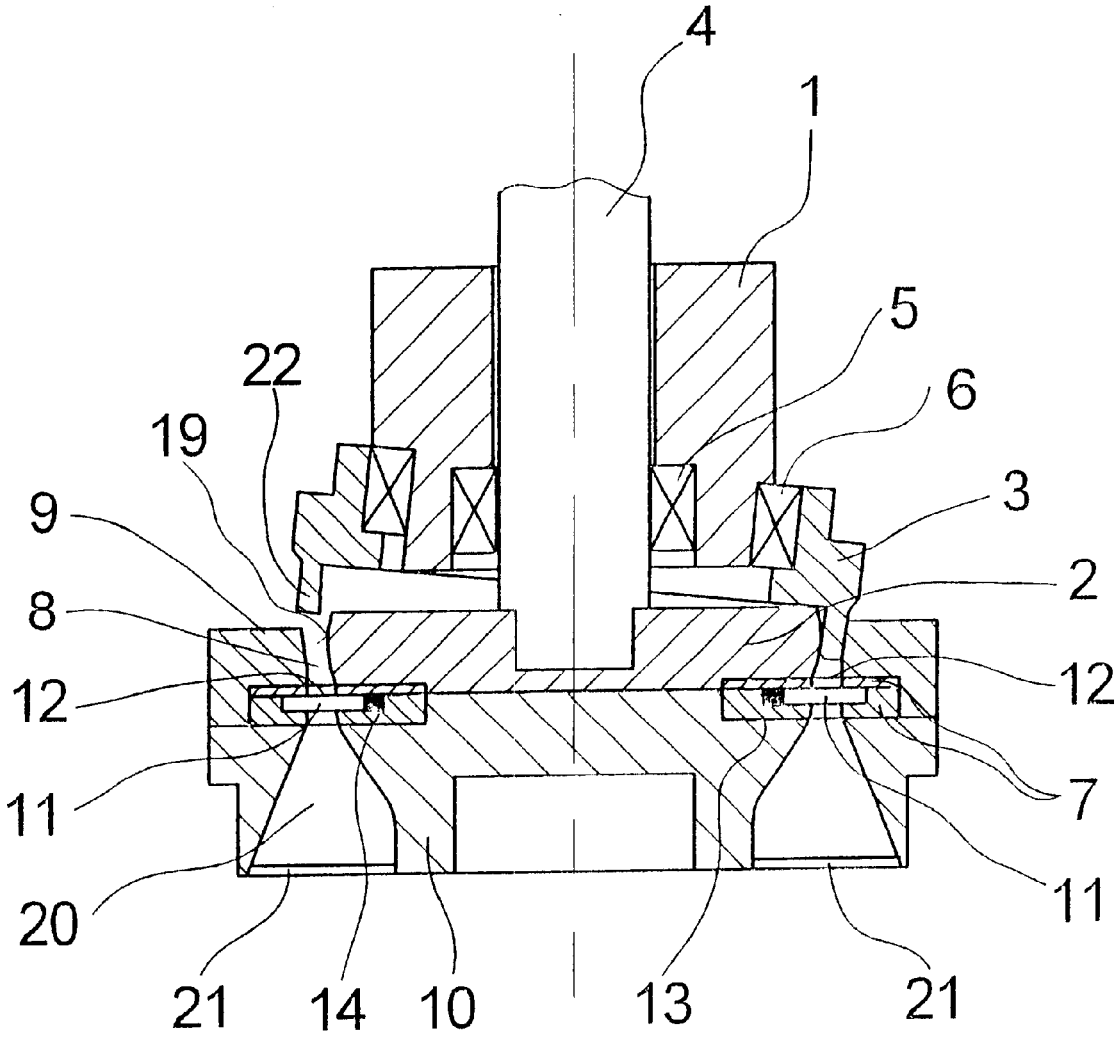
FIG. 1 is a schematic view of the device according to an embodiment of the present invention.

FIG. 1 shows schematic longitudinal cross-section of an embodiment of the device of the present invention. The device is provided with a bearing housing 1 which is penetrated by a drive shaft 4. The drive shaft 4 is positioned so that it can be rotated within the bearing housing 1 by the bearing 5. A cutter supporting member 2 is mounted on the free end that extends out of the bearing housing 1 of the drive shaft 4. The opposite end of the drive shaft 4 is joined to the drive not shown here.

The cutter supporting member 2 is cylindrical in shape and has a ball-shaped guide surface 19 along its circumference. The guide area 19 ends in an annular channel 8 in its longitudinal direction. The annular channel 8 is formed by a guiding ring 9 and a drum 10, which are mounted to the cutter supporting member 2. The annular channel 8 flows into an exiting channel 20 formed above the drum 10. The exiting channel 20 is broken up by several horizontal ribs 21 of the drum 10. Between the annular channel 8 and the exiting channel 20, a holding device 7 is held on the cutter supporting member 2 by a plurality of cutting blades 11. The connection between the annular channel 8 and the exiting channel 20 is penetrated here by the cutting blades 11 oriented radially to the cutter supporting member 2, wherein the cutting surface 12 of the cutting blades 11 point in the direction of the annular channel 8. To this end, the cutting blades are affixed in a cutter receiving member 13, whose design is explained in more detail below.

Above the cutter supporting member 2 is a pressing ring 3 set at an incline over the bearing 6, rotatably positioned along the circumference of the bearing housing 1. The pressing ring 3 has an annular base 22, which dips into the annular channel 8 via a portion of the circumference of the cutter supporting member 2. The pressing ring 3 is guided along the bearing house 1 and is freely rotatable.

In the embodiment of the device of the present invention shown in FIG. 1, none of the fasteners used to bind the parts in particular to the cutter supporting member 2 are shown. A detailed description of such fasteners is disclosed in EP 0 058 743 or EP 0 059 234 A1.

For cutting a fiber cable, a cutter supporting member 2 is driven in a rotational direction by a drive shaft 4. In this process, on the ball-shaped guide surface 19 a fiber cable is pulled into the annular channel 8 between the rotating cutter supporting member 2 and the pressing ring 3 that is positioned at an incline. Due to friction, the pressing ring 3 runs along with the fiber cable. After a rotation of 180° the fiber cable is pressed against the radially positioned cutting blades 11 by the base 22 of the pressing ring 3 within the annular channel 8, so that the fiber cable is cut into fibers of certain lengths by the cutting blades 11 arranged at a distance from one another. The fibers are pressed downward through the spaces between the cutting blades 11 and exit through the exiting channel 20. Here, the lengths of the fibers are determined by the distance between two neighboring cutting blades 11. The cutting blades 11 that are used in those areas are determined by the width of the annular channel 8. The width of the annular channel 8 forms a cutting width acting on the cutting blades 11. In order to ensure the fixation of a cutting blade 11, the cutting blades 11 have a blade width that is several times the cutting width. In order to achieve a high utilization of the cutting blades 11, the cutting blades 11 are supported in the holding device 7 in a radial direction by a replaceable supporting ring 14.

FIG. 2.1 and FIG. 2.2 show a cross-sectional view the holding device 7 of the embodiment shown in FIG. 1. The holding device 7 is shown in FIG. 2.1 with a first cutter position and in FIG. 2.2 in a second cutter position. Since no express reference is made to one particular figure, the following description applies to both figures.

The holding device 7 consists of a cutter holder 15 and a holding ring 16. The cutter receiver member 13 is formed between the cutter holder 15 and the holding ring 16. The cutter holder 15 is held directly against the cutter supporting member 2, wherein the annular channel 8 extends into the holding device 7 up to the exiting channel 20. Here, the cutter holder 15 and the holding ring 16 are each formed from an inner component 15.1 and 16.1 as well as an annular outer component 15.2 and 16.2, which are joined to one another by a fastener 18. The annular channel 8 which extends into the holding device 7 is therefore only penetrated by the radially oriented cutting blades 11, wherein the cutting surface 12 is positioned upwards against the base 22 of the pressing ring 3.

FIG. 2.1 shows the holding device with a first cutter position of the cutting blades 11. The cutting blades 11 are held radially in the cutter receiving member 13 in an outer position relative to the cutter supporting member 2. To this end, the inner ring 14.1 is arranged in the cutter receiving member 13. The cutting blades 11 are supported in the cutter receiving member 13 in a radial direction inwardly against the inner ring 14.1.

Once the area of the cutting surface 12 that is arranged in the annular channel 8 has become dull, the process is stopped temporarily so that the cutting position can be changed. To this end, the holding device 7 is released from the cutter supporting member 2 and disassembled. The inner ring 14.1 is replaced by an outer ring 14.2. Here, the cutting blades 11 are shifted from the radially outer position into a radially inner position on the cutter holder 15. FIG. 2.2 shows the second cutter position. The cutting blades 11 are supported on the outside in a radial direction against the outer ring 14.2. Here, the ring width of the inner ring 14.1 or the outer ring 14.2 is designed to be larger or the same size as the cutting width determined by the annular channel 8, which acts on the cutting blades 11 and is used to cut the fiber cable.

Once the second usable area of the cutting surface 12 on the cutting blades 11 has become dull, the process is temporarily stopped once again and the holding device 7 is disassembled from the cutter supporting member 2. The cutting blades 11 are then removed from the cutter holder 15 and after being turned 180° are placed back into the holding device 7. In this process, the cutting blades 11 remain in the inner position and are supported by the outer ring 14.2. After they have been reassembled, the process can be continued with the same cutting blades 11 that can now be used in a third area of the cutting surface 12. This is due to the cutter receiving member 13 in the holding device 7 being formed asymmetrically to the annular channel 8. This yields a longer and a shorter feed side on the cutting blades. As shown in FIGS. 2.1 and 2.2, the radially inner feed side of the cutting blades 11 in reference to the annular channel 8 extends further than the radially outer feed side of the cutting blades 11. The difference in lengths is preferably equal to or larger than the effective cutting widths.

Figure 3:
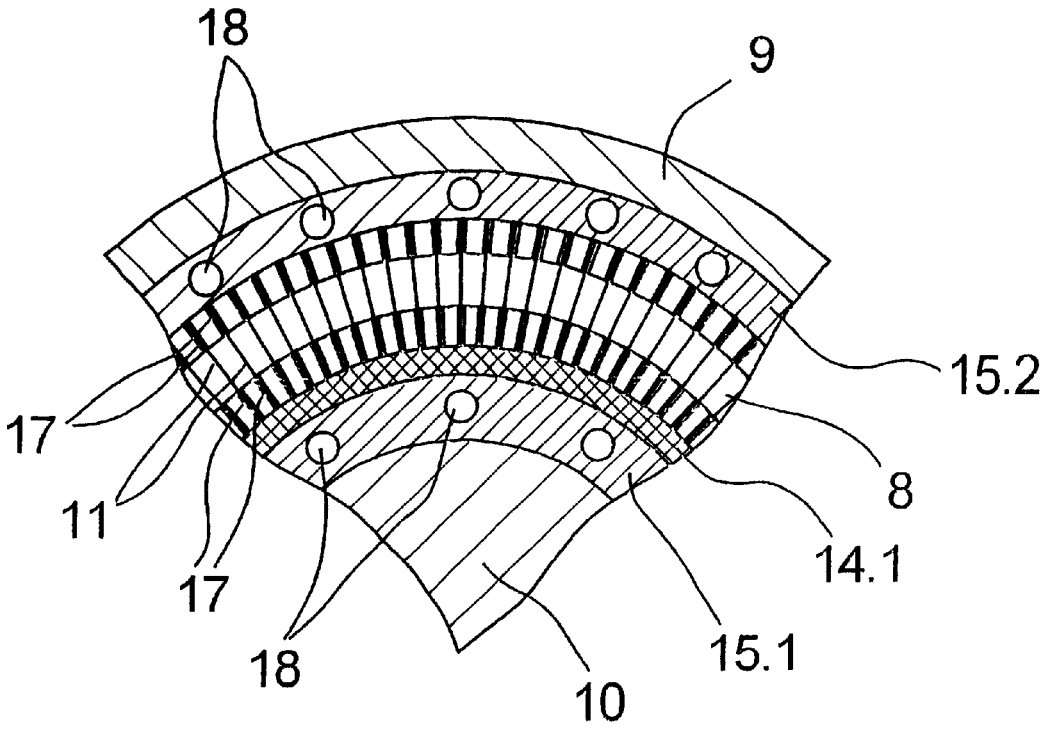
FIG. 3 is a schematic cross-sectional view of the device of FIG. 2.1.

Because the cutting blades 11 are received in the cutter holder 15, changing the cutting positions and replacing the cutting blades 11 can be carried out without great risk of injury. To this end, FIG. 3 shows an excerpt of a longitudinal cross-section through the device in accordance with the present invention. Here, the longitudinal cross-section runs through the cutting level. The cutter holder 15 is provided with a plurality of slots 17 for receiving the cutting blades 11. The cutting blades 11 are held with the cutting surface 12 in the slots 17 of the cutter holder 15 and are movable. The inner ring 14.1 is received in the cutter receiving member 13, which essentially is arranged in the holding ring 16, and holds the cutting blades 11 in a radially outer position. When the cutting blades 11 are moved or replaced, the cutting surface 12 always faces downward, thus significantly reducing the risk of injury.

Thus, the device according to the present invention provides a high degree of utilization and simple handling. In addition, the cutting surfaces are subjected to less stress because of the use of high-quality cutters with very smooth side flanks. Another problem that is solved by the present invention is that of so-called short cuts wherein the compression of fiber in the longitudinal direction can cause a great deal of stress. For instance, for a 4 mm cut and a blade diameter of 1 mm, the fibers are compressed by about 25% so that they can pass through the space between the two cutters. The very smooth side flanks of the cutting blades in accordance with the present invention allow for a reduction of the stress on the cutters.

List of Reference Numerals

1. Bearing housing
2. Cutter supporting member
3. Pressing ring
4. Drive shaft
5. Bearing
6. Bearing
7. Holding device
8. Annular channel
9. Guide ring

10. Drum
11. Cutting blade
12. Cutting surface
13. Cutter receiving member
14. Supporting ring
14.1 Inner ring
14.2 Outer ring
15. Cutter holder
15.1 Cutter holder (inner)
15.2 Cutter holder (annular)
16. Holding ring
16.1 Holding ring (inner)
16.2 Holding ring (annular)
17. Slot
18. Fixing medium
19. Guide surface
20. Exiting channel
21. Horizontal rib
22. Base

What is claimed is:

1. A device for cutting a fiber cable comprising:

a rotatably driven cutter supporting member;

a rotary positioned pressing ring that is positioned at an incline relative to the cutter supporting member and that extends into an annular channel that runs along the outer edge of the cutter supporting member;

a holding device that can be released from the cutter supporting member, said holding device comprising:

a ring-shaped cutter receiving member for holding a plurality of cutting blades arranged radially to the cutter supporting member; and an inner ring and an outer ring alternately placeable within the cutter receiving member, said outer ring having a larger diameter than said inner ring, wherein when said inner ring is positioned within the cutter receiving member, the cutting blades are supported in a radially outward position, wherein when said outer ring is positioned within the cutter receiving member, the cutting blades are supported in a radially inward position;

in the radial direction and allows the cutting blades to radially move, said supporting ring being replaceable and being formed by an outer ring enclosing the cutting blades or by an inner ring enclosing the cutting blades;

wherein the annular channel is penetrated by the plurality of cutting blades; and wherein the cutting blades have a blade width that is larger than a cutting width determined by the width of the annular channel, such that different portions of said cutting blades are positioned in the annular channel when switching said inner and outer rings.

2. The device of claim 1 wherein the outer ring has a ring width that is larger than the cutting width acting on the cutting blades.

3. The device of claim 1, wherein the holding device is held on the cutter supporting member such that the cutter receiving member is oriented asymmetrical to the annular channel.

4. The device of claim 1, wherein the holding device comprises a cutter holder and a holding ring and wherein the cutter receiving member is disposed between the cutter holder and the holding ring.

5. The device of claim 4 wherein the cutter holder and the holding ring are each formed by an inner component and an outer component that are joined to an exiting channel in an extension of the annular channel.

6. The device of claim 1, wherein the cutter holder is provided with a plurality of slots corresponding to the number of cutting blades and wherein the cutting blades are held with their sharp cutting surfaces in the slots and are radially moveable.

* * * * *